US007058349B2

(12) United States Patent
Kamimura

(10) Patent No.: US 7,058,349 B2
(45) Date of Patent: Jun. 6, 2006

(54) DEVELOPMENT UNIT HAVING A LAYER-THICKNESS, REGULATOR WITH CONTACT PORTION, AND METHOD OF MANUFACTURING THE DEVELOPMENT UNIT

(75) Inventor: Naoya Kamimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/958,431

(22) Filed: Oct. 6, 2004

(65) Prior Publication Data

US 2005/0074262 A1 Apr. 7, 2005

(30) Foreign Application Priority Data

Oct. 7, 2003 (JP) ..... 2003-347983

(51) Int. Cl.
*G03G 15/08* (2006.01)

(52) U.S. Cl. ..... 399/361; 399/274; 399/284

(58) Field of Classification Search ..... 399/284, 399/274

See application file for complete search history.

(56) References Cited

U.S. PATENT DOCUMENTS 5,867,758 A * 2/1999 Yoshida et al. ..... 399/284

FOREIGN PATENT DOCUMENTS

| | | | |
|---|---|---|---|
| JP | 04355777 A | * | 12/1992 |
| JP | A 5-72878 | | 3/1993 |
| JP | 06067520 A | * | 3/1994 |
| JP | A 8-30102 | | 2/1996 |
| JP | 09050181 A | * | 2/1997 |
| JP | A 10-333429 | | 12/1998 |

* cited by examiner

*Primary Examiner*—Quana Grainger
(74) *Attorney, Agent, or Firm*—Oliff & Berridge, PLC

(57) ABSTRACT

A development unit including: (a) a developer storage storing a developer; (b) a developer receiver disposed in an end portion of the developer storage and having a depository surface on which the developer is to be deposited; and (c) a regulator including a contact portion held in pressing contact with the depository surface of the developer receiver so as to regulate a thickness of the developer deposited on the surface of the developer receiver The regulator farther includes a base portion contiguous to the contact portion and extending from the contact portion in a direction toward the other end portion of the developer storage. An acute angle is defined by a base-portion plane on which the base portion of the regulator lies and a tangential plane which is tangent, at a contact portion of the depository surface held in contact with the contact portion of the regulator, to the depository surface. Also disclosed are an image forming apparatus including the above-described development unit, and a method of manufacturing the above-described development unit.

29 Claims, 10 Drawing Sheets

DEVELOPMENT UNIT HAVING A LAYER-THICKNESS, REGULATOR WITH CONTACT PORTION, AND METHOD OF MANUFACTURING THE DEVELOPMENT UNIT

This application is based on Japanese Patent Application No. 2003-347983 filed in Oct. 7, 2003, the content of which is incorporated hereinto by reference.

BACKGROUND OF THE INVENTION

1. Field of the Invention

The present invention relates to a layer-thickness regulator for regulating a thickness of a layer formed of a developer deposited on a surface of a developer receiver, a development unit including such a layer-thickness regulator, and an image forming apparatus including such a development unit. The invention is also concerned with a method of manufacturing the development unit.

2. Discussion of Related Art

There is known an image forming apparatus, as disclosed in JP-A-H10-333429, which forms an image by applying toner particles onto a medium such as a paper sheet and fixing the toner particles onto the medium. In this image forming apparatus, the toner particles are supplied from a toner storage onto a depository surface of a developer roller, and the toner particles are then applied by the developer roller onto a desired portion of a surface of a photosensitive drum. The toner particles are transferred from the photosensitive drum onto the medium, and the transferred toner particles are then fixed onto the medium.

Such an image forming apparatus is equipped with a layer-thickness regulator for regulating a thickness of a layer formed of the toner particles deposited on the depository surface of the developer roller, so as to make the thickness of the toner layer uniform. In the image forming apparatus disclosed in JP-A-H10-333429, the layer-thickness regulator provided in a development unit of the apparatus is constituted principally by a blade consisting of an elastic thin plate member which is made of a stainless steel or other material, so that an excess portion of the toner layer is removed by the blade so as to be dropped from of the developer roller. This blade includes a contact portion which is held in pressing contact with the developer roller, and a base portion which is held by a supporter fixed to a developer storage of the development unit. The blade is bent about 60° such that the base portion and the contact portion cooperate to define an angle of about 120°. The base portion of the blade extends upwardly from a bottom of the developer storage toward the developer roller.

In the above-described image forming apparatus, the development unit has to be necessarily given a large vertical dimension or height, since the base portion of the blade extends in the vertical or height direction of the development unit.

In general, an image forming apparatus is required to be small in size, and accordingly a development unit that is to be incorporated in the image forming apparatus is also required to be small in size Particularly, in recent years, there is a strong demand for a laser printer capable of performing a full-color printing operation. Such a color laser printer is equipped with a plurality of development units which are superposed on each other within a main body of the printer. It is therefore preferable that each of the development units has a small dimension as measured in its vertical direction, i.e., in a direction in which the development units are superposed on each other.

For reducing the vertical dimension of the development unit, it might be possible to attach a blade having the same shape as the blade disclosed in JP-A-H10-333429, to the developer storage such that the base portion of the blade extends in the horizontal direction rather than in the vertical direction. However, in this modified arrangement, for permitting the contact portion of the blade to be brought into contact with the developer roller, the base portion of the blade has to be arranged to extend from the contact portion in a direction toward the photosensitive drum, thereby making it impossible to sufficiently reduce the size of the development unit, and also causing risk of contact of the base portion of the blade with the photosensitive drum, which contact would result in deterioration in the quality of image formed in the apparatus. In this modified arrangement, even if the base portion of the blade were given a reduced length for avoiding its contact with the photosensitive drum, the vertical dimension of the development unit still can not be reduced to a sufficient extent, due to the presence of fixing means such as screw bolts required for fixing the blade to the developer storage. That is, the vertical dimension of the development unit still has to be large enough to avoid contact of the fixing means with the developer roller.

It might be also possible to attach the blade to the developer storage such that the base portion of the blade extends from the contact portion in the opposite direction, i.e., in a direction away from the photosensitive drum. However, in this modified arrangement, the contact portion of the blade is made brought into contact, at its distal end rather than at its surface, with the developer roller. Namely, the blade and the developer unit can not be held in pressing contact with each other through a sufficiently large area, whereby the thickness of the toner layer can not be reliably made uniform.

SUMMARY OF THE INVENTION

It is therefore a first object of the invention to provide a development unit which has a simple construction enabling a developer to be uniformly deposited on a developer receiver of the unit and which can be made compact in size. It is a second object of the invention to provide an image forming apparatus including the development unit which provides the above-described technical advantages. It is a third object of the invention to provide a layer-thickness regulator which enables the developer to be uniformly deposited on the developer receiver and which permits the development unit to be made compact in size. It is a fourth object of the invention to provide a method of manufacturing the development unit which provides the above-described technical advantages. The first object may be achieved according to either first or second aspect of the invention which is described below. The second object may be achieved according to a third aspect of the invention which is described below. The third object may be achieved according to a fourth aspect of the invention which is described below. The third object may be achieved according to a fourth aspect of the invention which is described below. The fourth object may be achieved according to a fifth aspect of the invention which is described below.

The first aspect of the invention provides a development unit comprising: a developer storage storing a developer; a developer receiver disposed in one of opposite end portions of the developer storage and having a depository surface on which the developer is to be deposited; and a regulator including a contact portion which is held in pressing contact with the depository surface of the developer receiver so as to regulate a thickness of the developer deposited on the depository surface of the developer receiver. The regulator further includes a base portion which is contiguous to the contact portion and which extends from the contact portion in a direction toward the other of the opposite end portions of the developer storage. An acute angle is defined by a base-portion plane on which the base portion of the regulator lies and a tangential plane which is tangent, at a contact portion of the depository surface held in contact with the contact portion of the regulator, to the depository surface.

In the present developer unit, the developer stored in the developer storage is supplied to the developer receiver, and the supplied developer is then deposited on the depository surface of the developer receiver, so that a layer is formed of the developer on the depository surface. An excess portion of the developer layer is removed by the contact portion of the regulator from the depository surface, whereby the thickness of the developer layer is made substantially uniform, namely, whereby the developer is uniformly deposited on the depository surface of the developer receiver. The regulator includes the base portion which is contiguous to the contact portion and extends from the contact portion in the direction toward the above-described other of the opposite end portions of the developer storage. The regulator may be bent more than 90° such that the acute angle is defined by the above-described base-portion plane and tangential plane.

Owing to the arrangement in which the regulator is bent more than 90° with its base portion extending from its contact portion in the direction toward the above-described other end portion of the developer storage, the base portion of the regulator is permitted to extend in the horizontal direction rather than in the vertical direction, without interference of the base portion of the regulator with an image carrier such as a photosensitive belt, so that the development unit can be made thin or small in its vertical dimension. That is, this arrangement makes it possible to reduce the vertical dimension of the development unit, which would have to be inevitably large in an arrangement in which the base portion of the regulator extends in the vertical direction. Further, since the regulator is bent more than 90°, the bent regulator is given an elastic force for restoring itself to its original shape. This elastic force can act as a pressing force by which the regulator is pressed against the depository surface of the developer receiver. Therefore, owing to the simple arrangement, the thickness of the developer deposited on the depository surface of the developer receiver can be made reliably uniform over the entirety of the depository surface. It is noted that the acute angle defined by the above-described base-portion plane and tangential plane is preferably about 40–80°, more preferably about 60°.

The second aspect of the invention provides a development unit comprising: a regulator which is provided by an elastic body; a first support member which is disposed on one of opposite sides of the regulator so as to support the regulator, and which has an end serving as a fulcrum about which the regulator is to be bent; a second support member which is disposed on the other of the opposite sides of the regulator, and which is bent to include an end portion extending in a direction toward the first support member, so as to render the regulator bent about the fulcrum; and a developer receiver which receives a developer. The regulator is forced by the developer receiver in such a direction that increases a degree of deflection or bend of the regulator.

In the development unit of this second aspect of the invention, the regulator is gripped at its opposite side surfaces by and between the first and second support members. The second support member is bent to include the end portion extending in the direction toward the first support member, so as to cause the regulator to be bent about the end of the first support member. The regulator is positioned relative to the developer receiver such that the regulator is forced by the developer receiver in such a direction that increases the degree of bend of the regulator.

Since the regulator is gripped by and between the first and second support members, the regulator can be assuredly fixed in a predetermined portion of the development unit. Further, when the regulator is fixed in the predetermined portion after having been attached to the first and second support members, the regulator can be easily fixed in the predetermined portion since the regulator has been already rendered bent by the second support member. Still further, since the regulator is bent, the regulator can be incorporated in the development unit even if the vertical dimension of the development unit is considerably small. In addition, since the regulator is forced by the developer receiver in such a direction that increases the degree of bend of the regulator, the regulator is pressed against the developer receiver by a sufficiently large pressing force, whereby the thickness of the developer deposited on a surface of the developer receiver can be made substantially uniform.

The third aspect of the invention provides an image forming apparatus comprising: the development unit defined in the above-described first or second aspect of the invention and operable to convert a latent image into a visible image; and a transfer unit operable to transfer the visible image to a medium.

The present image forming apparatus incorporating therein the development unit defined in the above-described first or second aspect of the invention, can be advantageously made compact in size.

The fourth aspect of the invention provides a layer-thickness regulator for regulating a thickness of a layer formed of a developer deposited on a depositary surface of a developer receiver which is disposed in a developer storage storing the developer. The layer-thickness regulator comprises: a regulator body made of an elastic material, and including a contact portion which is to held in pressing contact with the depositary surface of the developer receiver, and a base portion which is contiguous to the contact portion; and a supporter fixed to the developer storage and supporting the regulator body. The supporter supporting the regulator body is co red to render the regulator body bent such that the contact portion of the regulator body is inclined with respect to the base portion of the regulator body.

In the present layer-thickness regulator, the regulator body is held bent by the supporter. Therefore, where the layer-thickness regulator is used to be incorporated in a development unit with the regulator body being bent, the layer-thickness regulator can be easily fixed in a predetermined portion of the development unit.

The fifth aspect of the invention provides a method Of manufacturing a development unit comprising: (i) a developer storage storing a developer; (ii) a developer receiver disposed in the developer storage and having a depository surface on which the developer is to be deposited; and (iii) the layer-thickness regulator defined in the above-described fourth aspect of the invention, wherein the supporter of the layer-thickness regulator includes: a first plate member held in contact with one of opposite side surfaces of the base portion of the regulator body; and a second plate member including a contact portion held in contact with the other of the opposite side surfaces of the base portion of the regulator body, wherein the second plate member is bent so as to further include an end portion extending in a direction away from the contact portion of the second plate member toward the first plate member, so that the regulator body interposed between the first and second plate members is bent about an end of the first plate member. This method of manufacturing the development unit comprises: a layer-thickness regulator preparing step of preparing the layer-thickness regulator, by interposing the regulator body between the first and second plate members, such that the regulator body is bent about the end of the first plate member; a layer-thickness regulator attaching step of attaching the prepared layer-thickness regulator to the developer storage; and a developer receiver attaching step of attaching the developer receiver to the developer storage, and causing the developer receiver to force the contact portion of the regulator body in such a direction that increases a degree of bend of the regulator body.

According to the present method of manufacturing the development unit, the layer-thickness regulator is prepared such that the regulator body is bent about the end of the first plate member, and the prepared layer-thickness regulator is then attached to the developer storage. After the layer-thickness regulator has been attached to the developer storage, the developer receiver is attached to the developer storage, by forcing the developer receiver onto the contact portion of the regulator body in a direction toward the above-described other of the opposite end portions of the developer storage.

In this method of manufacturing the development unit, the developer receiver attaching step can be easily implemented, since the regulator body is bent in the layer-thickness regulator preparing step, namely, prior to the developer receiver attaching step. That is, in the developer receiver attaching step, the developer receiver can be attached to the developer storage without having to newly bend the regulator body from its original or non-bent shape.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENTS

Referring first to FIGS. 1–5, there will be described an image forming apparatus 1 constructed according to an embodiment of the invention.

Figure 1:
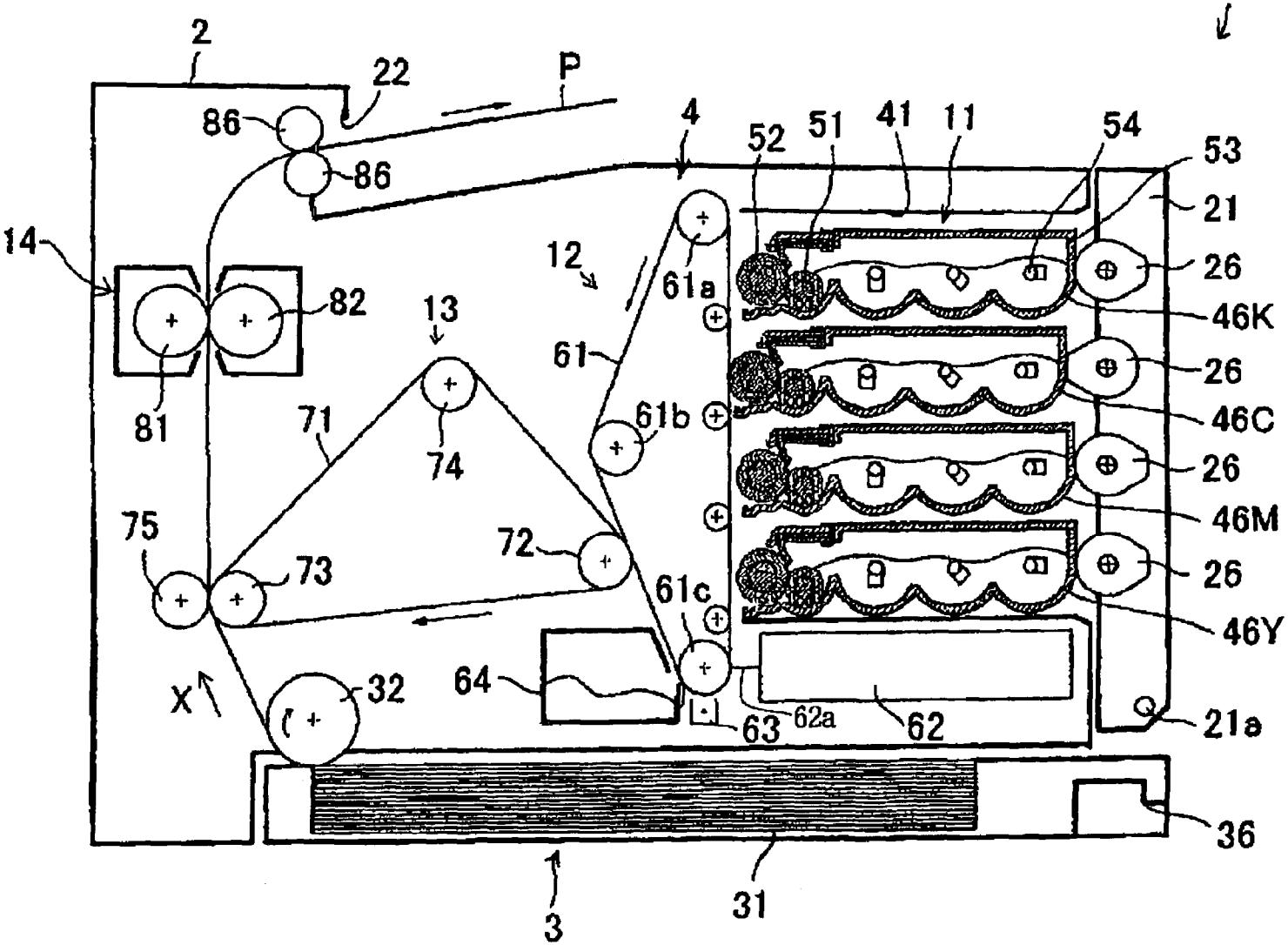
FIG. 1 is a side view partially in cross section of an image forming apparatus constructed according to an embodiment of the invention.

As shown in FIG. 1, the image forming apparatus 1 has a casing body 2 in which a media supplying portion 3 is located in its lower portion while an image forming portion 4 is located in its central portion.

On a rear side of the casing body 2 (i.e., on a right side of the casing body 2 as seen in FIG. 1), there is disposed a cover member 21 which is pivotable about a hinge pin 21*a* located in its lower end portion. Four eccentric ms 26 are rotatably fixed to the cover member 21, and are held in contact with rear side faces of respective four development units 46K, 46C, 46M, 46Y. With rotation of each of the cams 26, a corresponding one of the development units 46K, 46C, 46M, 46Y is forced by a lobe of each cam 26, so as to be displaced in the forward direction (i.e., in the leftward direction as seen in FIG. 1). With disengagement of the corresponding one of the development units 46K, 46C, 46M, 46Y from the lobe of each cam 26 as a result of further rotation of each cam 26, the corresponding one of the development units 46K, 46C, 46M, 46Y is forced by a coil spring (not shown) disposed on the front side of the corresponding one of the development units 46K, 46C, 46M, 46Y, so as to be displaced back in the rearward direction (i.e., in the rightward direction as seen in FIG. 1).

In an upper portion of the casing body 2, there is provided a media exit portion 22 for receiving a paper sheet P as a medium on which a desired image has been formed in the image forming portion 4.

The media supplying portion 3, which is located in the lower portion of the casing body 2, includes a media supply cassette tray 31 and a media supply roller 32.

The media supply cassette tray 31 having a generally rectangular shape is provided to accommodate a plurality of paper sheets P in a space defined therein. The cassette tray 31 has a drawer pull 36 which is provided by a recess formed in its rear end portion (i.e., in its right end portion as seen in FIG. 1). The cassette tray 31 can be drawn out from the casing body 2, by manually pulling the drawer pull 36 in the horizontal direction. The plurality of paper sheets P are stacked in the cassette tray 31 such that a top surface (on which the image is to be formed) of each paper sheet P faces upwardly The media supply roller 32 is rotatably held in contact with a forward end portion (i.e., the left end portion) of the uppermost one of the paper sheets P stacked in the cassette tray 31. With rotation of the media supply roller 32 in the clockwise direction as seen in FIG. 1, the upper most paper sheet p is fed in the direction as indicated by arrow X.

The image forming portion 4 is constituted by a development section 11, a photoreceptor section 12, an intermediate transfer section 13 and a fuser section 14.

The development section 11 is located in a rear side portion of the casing body 2 (i.e., in the right side portion of the casing body 2 as seen in FIG. 1). In the development section 11, there is provided a storage portion 41 for storing the above-described development units 46K, 46C, 46M, 46Y which contain developers in the form of toner particles of respective four colors.

In the storage portion 41 of the development section 11, the development unit 46M containing magenta toner (M) is superposed on the development unit 46Y containing yellow toner (Y), the development unit 46C containing cyan toner (C) is superposed on the development unit 46M, and the development unit 46K containing black toner (K) is superposed on the development unit 46C. The constructions of the development units 46 and the storage portion 41 will be described later more in detail.

The photoreceptor section 12 is located in a central portion of the casing body 2, and has a photosensitive belt 61 as an image carrier, a laser scanner 62, a charging device 63 and a cleaning unit 64.

The photosensitive belt 61 is held by pulley rollers 61*a*, 61*b*, 61*c*, and is operatively brought into contact with an intermediate transfer belt 71 and four developer rollers 52, which will be described later more in detail.

The charging device 63 is disposed in a lower portion of the casing body 2, and is opposed to an outside surface of the photosensitive belt 61. The charging device 63 applies a generally uniform charge on the outside surface of the photosensitive belt 61.

The laser scanner 62 is disposed below the storage portion 41, and is constituted principally by a laser light generator, a polygon mirror a lens and a reflection mirror (not shown), as well known in the art. The laser light generator generates a laser light 62*a* based on image data, and the generated laser light passes through or is reflected by the polygon mirror, lens and reflection mirror. The laser light 62*a* is eventually projected upon the outside surface of the photosensitive belt 61 which has been charged by the charging device 63, whereby an electrostatic latent image based on the image date is created on the outside surface of the photosensitive belt 61. Once the latent image is formed on the photosensitive belt 61, the toner particles are transferred to the photosensitive belt 61 in the form of a visible image.

The cleaning unit 64 is disposed on one of opposite sides of the charging device 63 that is remote from the laser scanner 62 (i.e., on the left side of the charging device 63 as seen in FIG. 1), for removing the toner particles remaining on the photosensitive belt 61.

The intermediate transfer section 13 is located between the photoreceptor section 12 and the fuser section 14, and is constituted principally by the intermediate transfer belt 71, a first pulley roller 72, a second pulley roller 73, a third pulley roller 74 and a transfer roller 75.

The intermediate transfer belt 71 is held at its three points by the first through third pulley rollers 72–74. It is noted that the first pulley roller 72 is positioned to be opposed with the photosensitive belt 61 while the second pulley roller 74 is positioned to be opposed with the transfer roller 75.

The intermediate transfer belt 71 is circulated with rotations of the first through third pulley rollers 72–74. The intermediate transfer belt 71 is held in contact at its portion supported by the first pulley roller 72, with the photosensitive belt 61. The visible image formed of the toner particles on the photosensitive belt 61 is transferred to the intermediate transfer belt 71. In the present embodiment, the visible images formed of the toner particles having the respective different colors are sequentially transferred to the intermediate transfer belt 71. After all of the visible images of the respective different colors have been transferred to the intermediate transfer belt 71, the paper sheet P is fed by the media supply roller 32. As the paper sheet P passes through the transfer roller 75 and the second pulley roller 73, the toner particles forming the color image are transferred from the intermediate transfer belt 71 onto the paper sheet P. The paper sheet P is then fed to the fuser section 14.

The fuser section 14 is disposed in a front side portion of the casing body 2 so as to be located above the transfer roller 75, and is constituted by a pair of fuser rollers 81, 82. As the paper sheet P passes through the fuser rollers 81, 82, the toner particles transferred onto the paper sheet P is fused by heat and pressure applied thereto from the fuser rollers 81, 82, so that the fused toner particles form a permanent image on the paper sheet P.

A pair of feed rollers 86 are disposed in the vicinity of the media exit portion 22 which is located above the fuser section 14. The paper sheet P on which the permanent image has been formed passes through the feed rollers 86, and is then received by the media exit portion 22.

Figure 2:
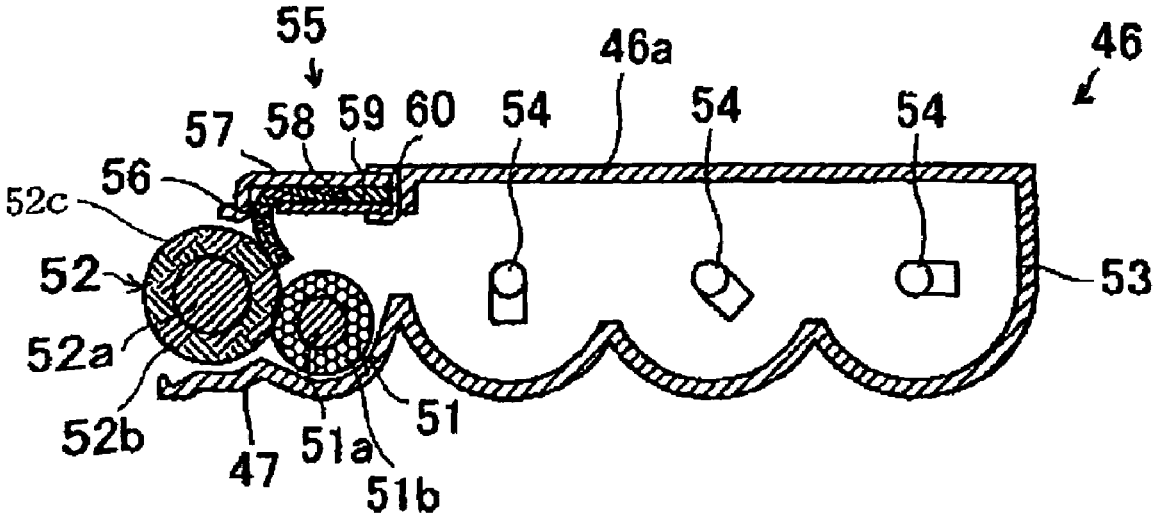
FIG. 2 is a side view partially in cross section of a development unit incorporated in the image forming apparatus of FIG. 1.
Figure 3:
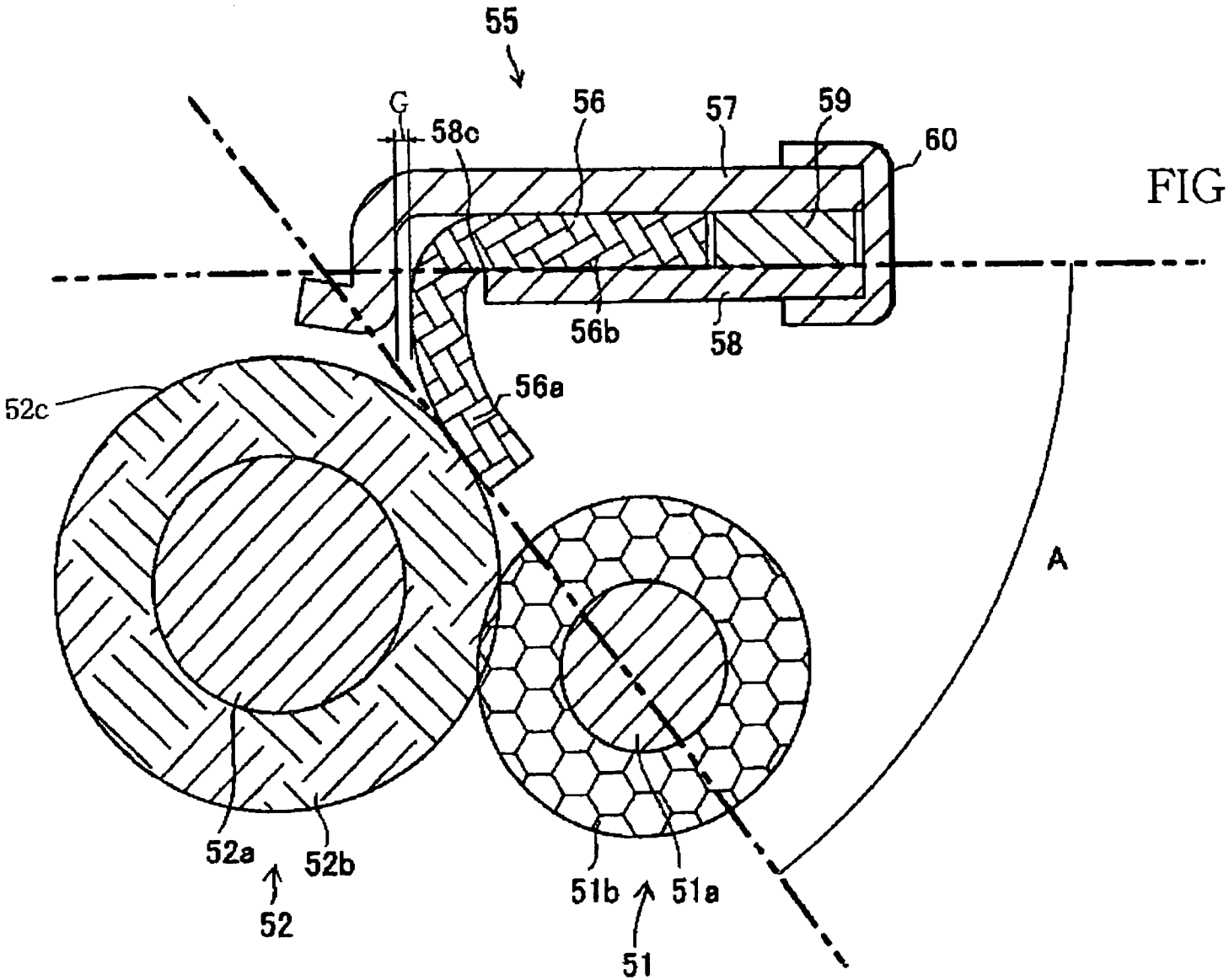
FIG. 3 is a view showing in enlargement a layer-thickness regulator included in the development unit of FIG. 2.
Figure 4:
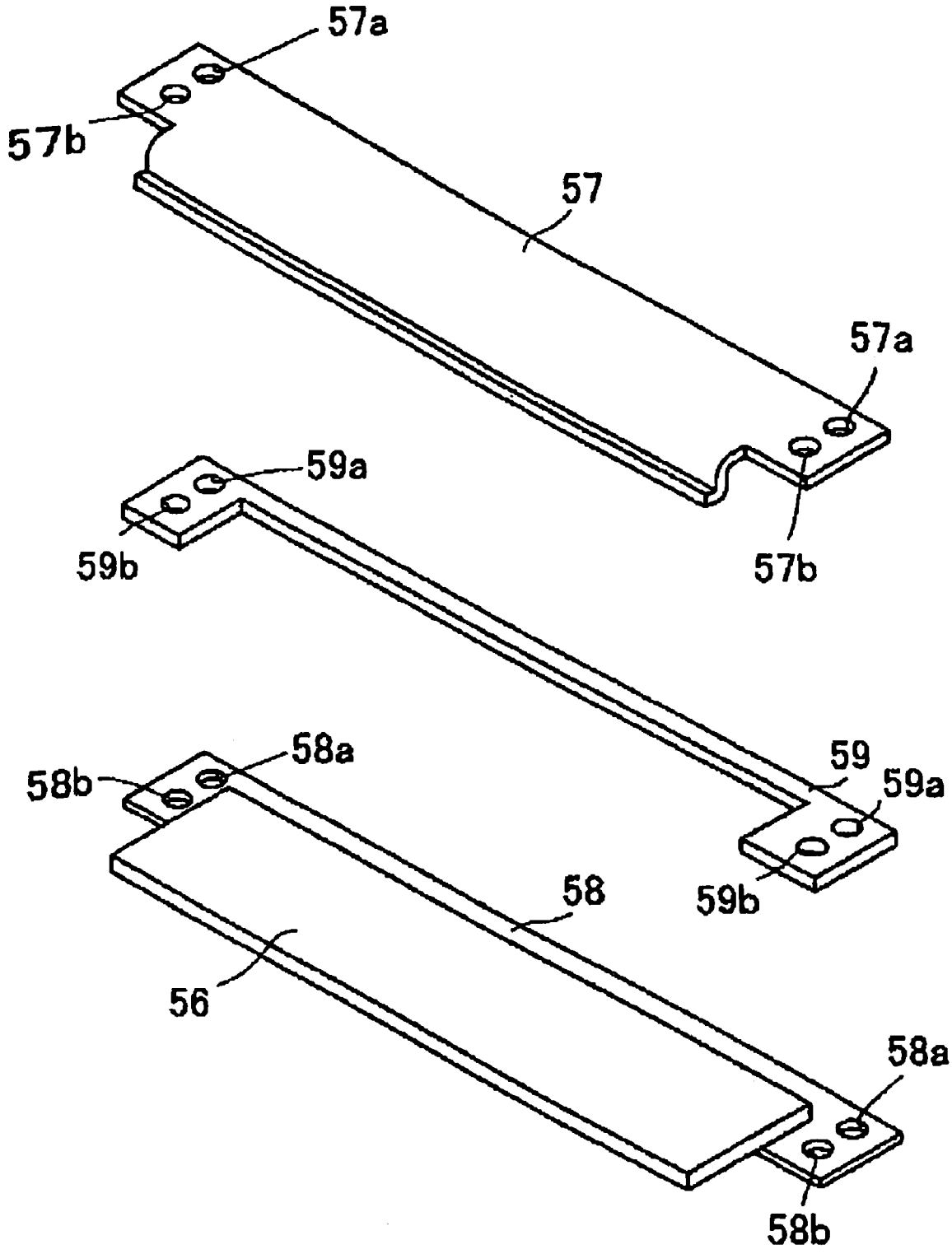
FIG. 4 is a perspective explosive view showing the layer-thickness regulator of FIG. 3.
Figure 5:
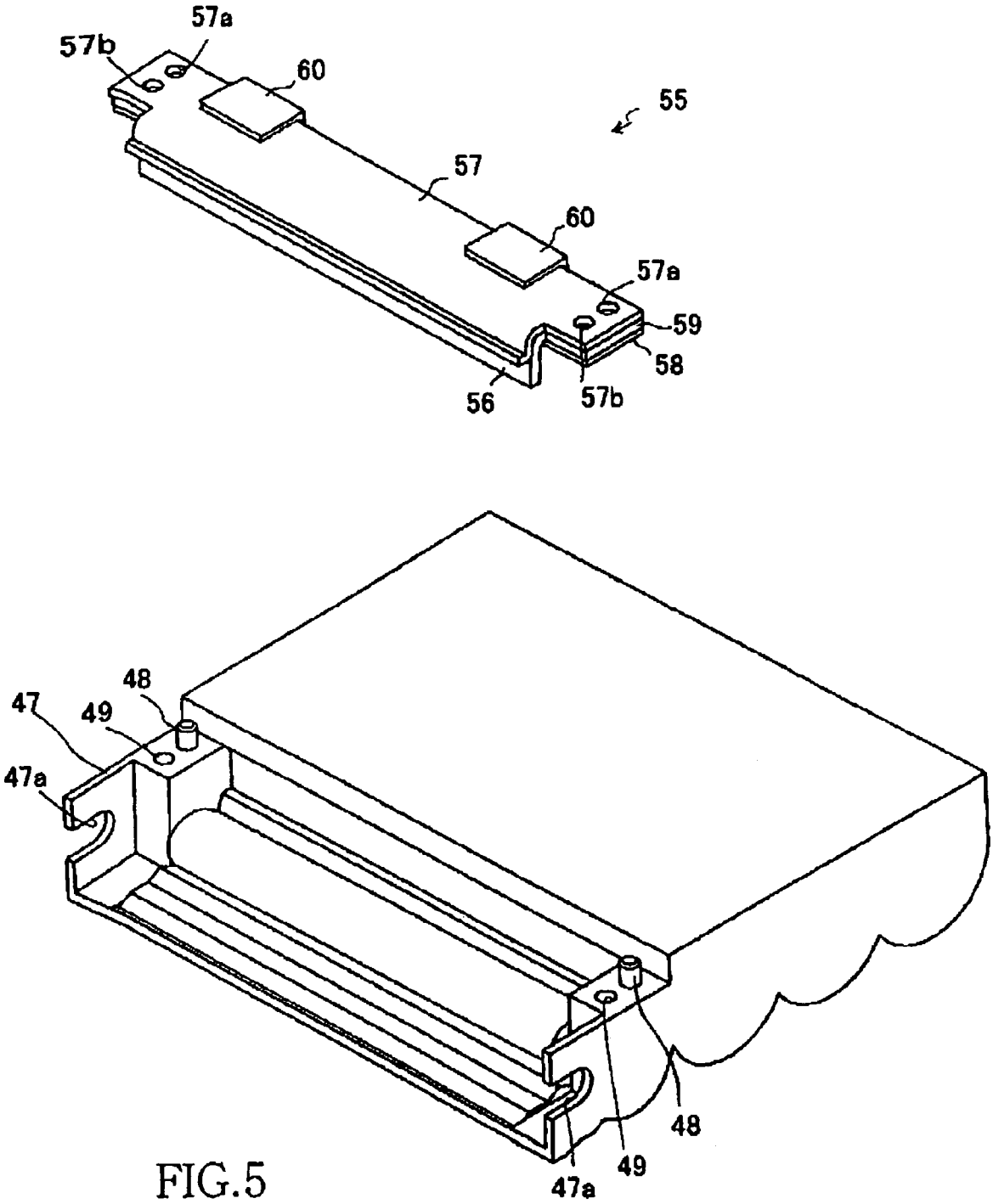
FIG. 5 is a perspective explosive view showing the development unit of FIG. 2.

The development unit 46 will be described in detail with reference to FIGS. 2–5. FIG. 2 is a side view partially in cross section of the development unit 46. FIG. 3 is a view showing in enlargement a layer-thickness regulator 55 included in the development unit 46 shown in FIG. 2. FIG. 4 is a perspective explosive view showing the layer-thickness regulator 55. FIG. 5 is a perspective explosive view showing the development unit 46.

As shown in FIG. 2, the development unit 46 includes a toner storage 53 and a supply roller 51 in addition to the above-described developer roller 52 and layer-thickness regulator 55.

The toner storage 53 serving as a developer storage is formed of a synthetic resin or the like, and has a bottom defined by three semi-cylindrical surfaces which are contiguous to each other. The toner storage 63 has an opening formed in its front end portion (i.e., in the left end portion of the toner storage 53 as seen in FIG. 2). In the toner storage 53, three agitator paddles 54 are provided to be located above the respective three semi-cylindrical surfaces. Each of the three agitator paddles 54 is elongated in a width direction of the toner storage 53 (i.e., a direction perpendicular to the drawing sheet of FIG. 2), and has an axle which is rotatably supported by inside walls of the toner storage 53. The toner particles stored in the toner storage 53 are agitated by the three agitator paddles 54, for maintaining uniformity of the toner particles in electrical potential level.

The toner storage 53 has a frame portion 47 as an opening-definer portion which defines the above-described opening and which is provided by the above-described front end portion, i.e., one of the opposite end portions of the toner storage 53. In the frame portion 47, the above-described supply roller 51 and developer roller 52 are rotatably attached such that an axial direction of each of the rollers 51, 52 is parallel with a width direction of the opening defined by the frame portion 47.

The supply roller 51 is located on the rear side of the developer roller 52, and has a metallic axle 51*a* which is rotatably supported by the inside walls of the toner storage 53. The metallic axle 51*a* is covered at its circumferential surface with a sponge member 51*b*. This supply roller 51 is rotated in the counterclockwise direction as seen In FIG. 3 so as to supply the toner particles stored in the toner storage 53, to the developer roller 52 which serves as a developer receiver.

The developer roller 52 is constituted by a metallic axle 52*a* and a coating layer 52*b* which covers a circumferential surface of the metallic axle 52*a*. The coating layer 52*s* is provided by an elastic body made of a conductive rubber material such as urethane rubber and silicon rubber containing carbon particles. The metallic axle 52*a* of the developer roller 52 is received in a pair of cutouts 47*a* which are formed in respective widthwise opposite end portions of the frame portion 47, such that the developer roller 52 is rotatably held by the toner storage 53, with the coating layer 52*b* being exposed to an exterior of the toner storage 53 through the above-described opening. It is noted that a developing bias voltage is applied to the developer roller 52 so as to allow the toner particles to be transferred from the developer roller 52 to the photosensitive belt 61.

The above-described layer-thickness regulator 55 is provided to be located above the developer roller 52, and includes a blade 56 as a regulator body or plate, an upper metallic plate 57 as a second support member, a lower metallic plate 58 as a first support member, a spacer member 59 as a spacer, and two clamp members 60 as a fixture. The upper and lower metallic plates 57, 58 cooperate with each other to constitute a blade supporter which is fixed to the toner storage 53 and supports the blade 56.

As shown in FIG. 3, the blade 56 includes a contact portion 56*a* which is held in pressing contact with an outer circumferential surface 52*c* of the developer roller 52, and a proximal or base portion 56*b* which is contiguous to the contact portion 56*a* and which extends from the contact portion 56*a* in a direction toward the above-described other of the opposite end portions of the toner storage 53, le., in the rightward direction as seen in FIG. 3. The base portion 56*b* of the blade 56 is fixed relative to a ceiling wall 46*a* of the toner storage 53, so as to be held in a horizontal posture, as shown in FIG. 2. The blade 56 is gripped at its base portion 56*b* by and between the upper and lower metallic plates 57, 58, and is bent about an end 58*c* of the lower metallic plate 58 which serves as a fulcrum, as shown in FIG. 2. The contact portion 56*a* of the thus bent blade 56 projects downwardly, and is inclined with respect to the base portion 56*b* which is held in the horizontal posture. The blade 56 is bent more than 90° such that an acute angle A is defined by a proximal-portion or base-portion plane (represented by two-dot chain line in FIG. 3) on which the base portion 56*b* of the blade 56 lies and a tangential plane (also represented by two-dot chain line in FIG. 3) which is tangent, at a contact portion of the outer circumferential surface 52*c* of the developer roller 52 held in contact with the contact portion 56*b*, to the outer circumferential surface 52*c* of the developer roller 52.

The end 58*c* of the lower metallic plate 58, about which the blade 56 is bent, is located between an axis of the axle 52*a* of the developer roller 52 and the above-described other end portion of the toner storage 53 as viewed in the horizontal direction. Further, the above-described contact portion of the outer circumferential surface 52*c* of the developer roller 52 is located between the axis of the axle 52*a* of the developer roller 52 and the above-described other end portion of the toner storage 53 as viewed in the horizontal direction. Still further, in the present embodiment, an intersection between the above-described base-portion plane and tangential plane is also located between the axis of the axle 52*a* of the developer roller 52 and the above-described other end portion of the toner storage 53 as viewed in the horizontal direction.

In the arrangement as described above, the downwardly projecting contact portion 56*a* of the blade 56 is forced by the developer roller 52 in a direction toward the above-described other end portion of the toner storage 53, whereby the contact portion 56*a* of the blade 56 and the developer roller 52 are pressed against each other by a sufficiently large pressing force. Further, since the above-described contact portion of the outer circumferential surface 62*c* of the developer roller 52 is located between the axis of the axle 52*a* of the developer roller 52 and the above-described other end portion of the toner storage 53 as viewed in the horizontal direction, the toner particles clinging to the developer roller 52 are removed by the blade 56 within the toner storage 53, without leakage of the toner particles out of the toner storage 53.

If the layer-thickness regulator 55 is positioned relative to the developer roller 52 such that the horizontal distance between the end 5*c* of the lower metallic plate 58 (about which the blade 56 is bent) and the axis of the developer roller 52 becomes smaller, namely, such that the end 58*c* of the lower metallic plate 58 is shifted in the leftward direction as seen in FIG. 3, a degree of bend of the blade and the above-described angle A are increased and reduced, respectively. If the angle A is thus reduced, the toner particles having entered a space between the base portion 56*b* and the contact portion 56*a* of the blade 56 are likely to stay in that space, thereby deteriorating circulation of the toner particles and accordingly losing uniformity of the toner particles in electrical potential level. In such an event, some of the toner particles would cling to non-image-forming areas of the outside surface of the photosensitive belt 61, causing a so-called "fog" in an image eventually printed on the paper sheet. It might be possible to avoid the entrance of the toner particles into the above-described space, for example, by bonding a sponge or the like onto a surface of the contact portion 56*a* of the blade 56 (i.e., a surface opposite to a contact surface at which the contact portion 56*a* is in contact with the developer roller 52). However, bonding the sponge on the above-described surface is difficult in such a case where the space between the base portion 56*b* and the contact portion 56*a* of the blade 56 is considerably narrow.

Figure 10A:
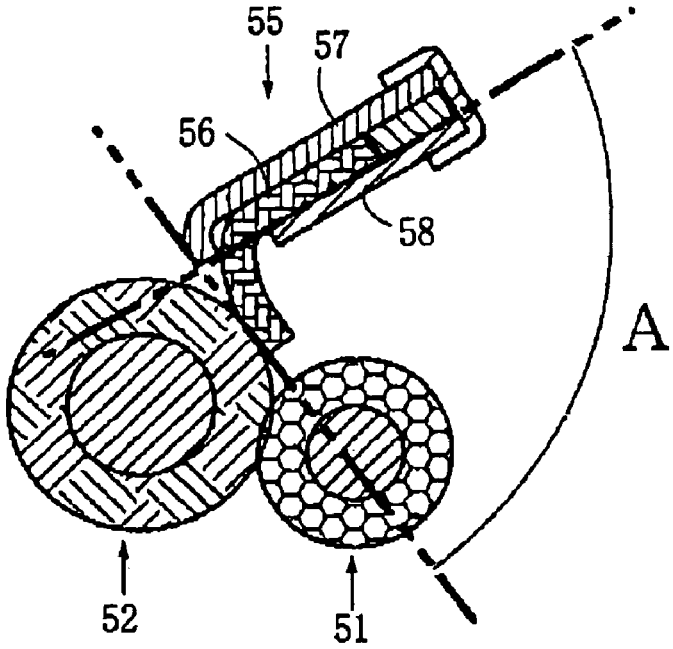
FIGS. 10A and 10B are views for explaining arrangements in which a blade is bent by a smaller angle than in the embodiment shown in FIGS. 1–5.
Figure 10B:
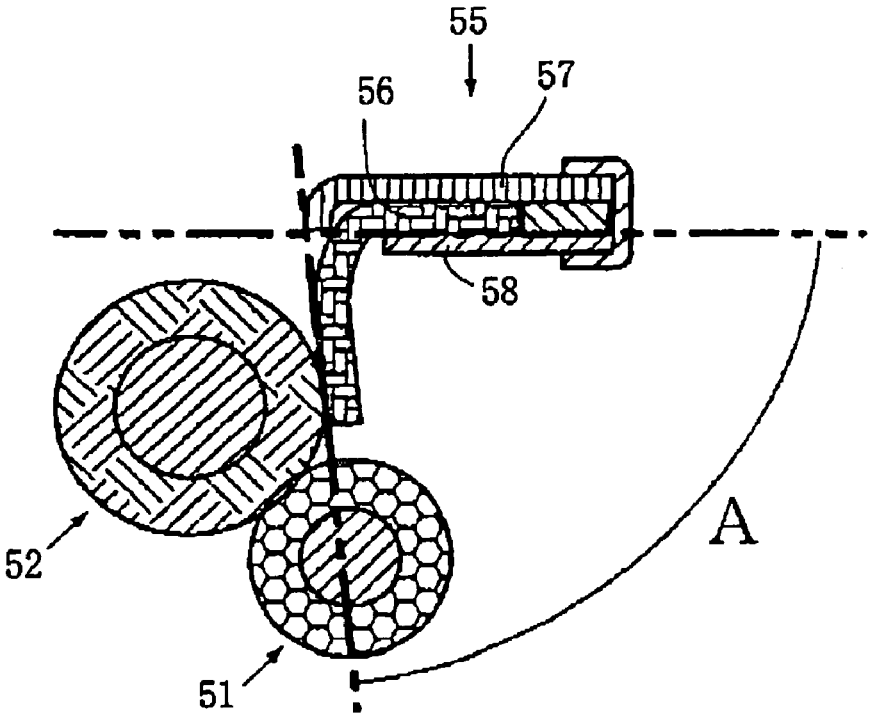

On the other hand, if the degree of bend of the blade 56 is reduced (namely, if the above-described angle A is increased) without changing a contact position in which the developer roller 52 and the blade 56 is in contact with each other, a distance between the contact position and the base portion 56*b* of the blade 56 as measured in the vertical direction is increased as shown in FIG. 10A, whereby the development unit 46 becomes larger in its vertical dimension. Further, if the degree of bend of the blade 56 is reduced without changing a support position in which the blade 56 is supported by the blade supporter, the contact position is shifted downwardly as shown in FIG. 10B, thereby requiring the position of the supply roller 51 to be also shifted downwardly, leading to an increase in the vertical dimension of the development unit 46.

The blade 56 is made of silicon rubber having a high degree of elasticity. The pressing force, by which the contact portion 56*a* of the blade 56 and the developer roller 52 are pressed against each other is constituted by an elastic force which is given to the blade 56 for restoring itself to its original shape. Therefore, if the thickness of the blade 56 is too small, the pressing force can not be large enough to assure the thickness uniformity of the toner layer formed on the developer roller 52. If the thickness of the blade 56 is too large, the blade 56 is difficult to be bent, making it difficult to attach the blade 56 to the toner storage 53 in an operation for assembling the development unit 46.

Appropriate values of the angle A and the thickness of the blade 56 and other details can be determined in view of various factors such as the length, degree of elasticity and hardness of the blade 56, the process of assembling the development unit 46, and the size of the development unit 46. In the present embodiment, the blade 56 is arranged to be bent such that the angle A is preferably about 40–80°, and more preferably about 60°. The thickness of the blade 56 is preferably about 1.0–2.5 mm.

A length of the contact portion 56*a* of the blade 56 as measured in the width direction of the toner storage 53 should be larger than the width of the paper sheet P, since this length of the contact portion 56*a* corresponds to a distance over which the toner layer can be made uniform. The length of the base portion 56*b* of the blade 56 is determined preferably depending upon various factors such as the length of the contact portion 66*a* of the blade 56, the hardness and degree of elasticity of the blade 56, and an expected amount of the pressing force by which the contact portion 56*a* of the blade 56 and the developer roller 52 are pressed against each other. However, the length of the base portion 56*b* is not particularly limited as long as it is large enough to enable the blade 56 to be reliably gripped by suitable means such as the blade supporter which is constituted by the upper and lower metallic plates 57, 58, As shown in FIG. 4, the lower metallic plate 58 is provided by a rectangular-shaped thin plate, and is bonded to a lower surface of the base portion 56*b* of the blade 56. The length of the lower metallic plate 58 (as measured in the width direction of the toner storage 63) is larger than the length of the blade 56 (as measured in the width direction of the toner storage 53). In each of opposite end portions of the lower metallic plate 58 which do not overlap with the blade 56, there are formed two tough-holes 58*a*, 58*b* each having a circle cross section. The through-hole 58*a* serves as an engager of a positioning mechanism for establishing a predetermined positional relationship between the layer-thickness regulator 55 and the toner storage 53. The through-hole 58*b* is provided for receiving a screw bolt serving to fix the layer-thickness regulator 55 to the toner storage 53.

The spacer member 59 is provided by a rigid member having a thickness substantially equal to or slightly smaller than the thickness of the blade 56. The spacer member 59 has a cutout formed in its intermediate portion, so as to be configured to cover a portion of the lower metallic plate 58 which portion does not underlie the blade 56. Further, like the lower metallic plate 58, the spacer member 59 has two through-holes 59*a*, 59*b* formed in each of its opposite end portions. The through-hole 59*a* serves as an engager of the above-described positioning mechanism, while the through-hole 59*b* is provided for receiving the above-described screw bolt.

The upper metallic plate 57 is provided by a thin plate, and is superposed on the blade 56 and the spacer member 59. The upper metallic plate 57 is bent to include a front end portion extending in the downward direction. The front end portion of the upper metallic plate 57 has cutouts at its opposite ends, so that the front end portion is given a length smaller than that of the other portion of the upper metallic plate 57. However, the length of the front end portion of the upper metallic plate 57 is substantially equal to or larger than that of the blade 56. Further, like the lower metallic plate 58 and the spacer member 59, the upper metallic plate 57 has two through-holes 57*a*, 57*b* formed in each of its opposite end portions. The through-hole 57*a* serves as an engager of the above-described positioning mechanism, while the through-hole 57*b* is provided for receiving the above-described screw bolt.

As shown in an upper part of FIG. 5, the upper metallic plate 57, the spacer member 59 and the lower metallic plate 58 (onto which the blade 56 is bonded) are superposed on each other such that the through-holes 57*a*, 58*a*, 59*a* are aligned with each other while the through-holes 57*b*, 58*b*, 59*b* are aligned with each other. The two clamp members 60 each having a substantially U shape are provided to grip respective two portions of a rear end portion of an assembly of the blade 56, upper metallic plate 57, lower metallic plate 58 and spacer member 59 (i.e., two portions of the right end portion of the assembly as seen in FIG. 3). The upper and lower metallic plates 57, 58 and the spacer member 59 are thus gripped by the U-shaped clamp members 60, whereby the blade 56 is fixedly interposed between the upper and lower metallic plates 57, 58.

As shown in a lower part of FIG. 5, a protrusion or boss 48 and a tapped hole 49 are formed in each of opposite end portions of the frame portion 47 of the toner storage 53. The boss 48 serves as an engager of the above-described positioning mechanism, and is fitted in the above-described holes 57*a*, 58*a*, 59*a* so as to establish the predetermined positional relationship between the layer-thickness regulator 55 and the toner storage 53. After the predetermined positional relationship has been thus established, a screw bolt is introduced into the above-described holes 57*b*, 58*b*, 59*b* and is then screwed into the tapped hole 49, whereby the layer-thickness regulator 55 is fixed to the toner storage 53.

While the blade 56 is bonded to the lower metallic plate 58 in the present embodiment, the blade 56 does not have to be necessarily bonded to the lower metallic plate 58 as long as the blade 56 is fixedly gripped by and between the upper and lower metallic plates 57, 58, Referring next to FIGS. 6A–6D and FIGS. 7A–7D, there will be described a process of manufacturing the development unit 46. FIGS. 6A–6D are views showing a layer-thickness regulator assembling or preparing step of assembling or preparing the layer-thickness regulator 55, while FIGS. 7A–7D are views showing a development-unit assembling step of assembling the development unit 46.

Figure 6A:
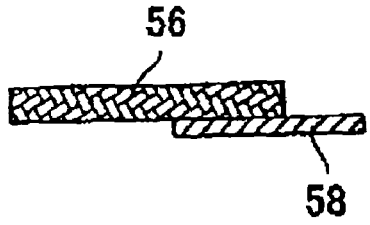
FIGS. 6A–6D are views showing a process of assembling the layer-thickness regulator of FIG. 3.
Figure 6B:
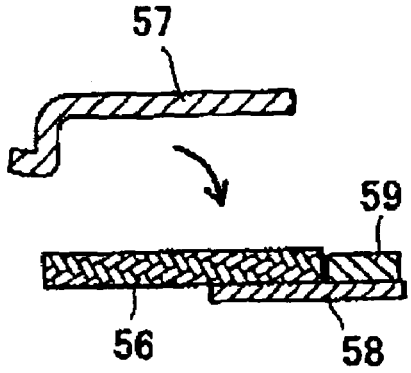
Figure 6C:
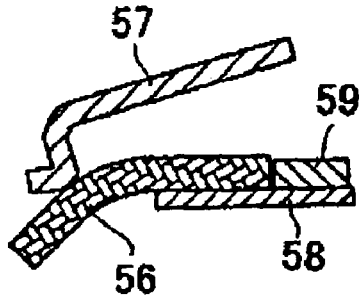
Figure 6D:
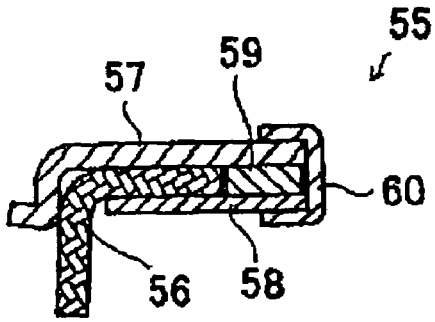

The layer-thickness regulator preparing step is initiated by bonding the base portion 56*b* of the blade 56 onto the lower metallic plate 58, as shown in FIG. 6A. The spacer member 59 is then superposed onto the portion of the lower metallic plate 58 which portion does not underlie the blade 56, as shown in FIG. 6B. The upper metallic plate 57 is superposed onto the blade 56 and the spacer member 69, as shown in FIG. 6C. In this instance, since the upper metallic plate 57 is bent to include the front end portion extending in the downward direction, the blade 56 is bent about the end 58*c* of the lower metallic plate 68 such that the contact portion 56*a* is inclined with respect to the base portion 56*b* by about 90°. When the upper metallic plate 57, spacer member 59 and lower metallic plate 58 are superposed on each other, the through-holes 57*a*, 58*a*, 59*a* are aligned with each other while the through-holes 57*b*, 58*b*, 59*b* are aligned with each other. The two U-shaped clamp members 60 are then provided to grip the respective two portions of the rear end portion of the assembly of the blade 66, upper metallic plate 57, lower metallic plate 58 and spacer member 59, as shown in FIG. 6D. Among FIGS. 6A–6D cooperating to show the layer-thickness regulator preparing step, FIGS. 6A–6C cooperate to show a first sub-step of the regulator preparing step, while FIG. 6D shows a second sub-step of the regulator preparing step.

Figure 7A:
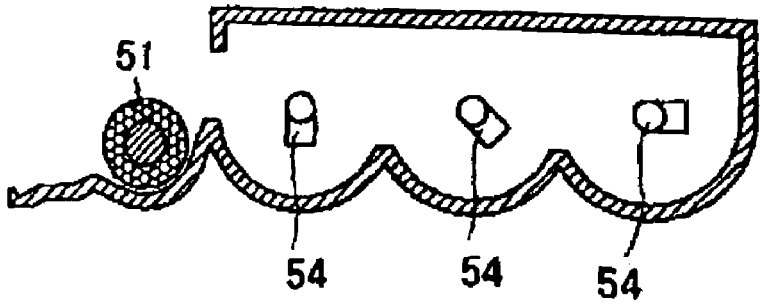
FIGS. 7A–7D are views showing a process of assembling the development unit of FIG. 2.
Figure 7B:
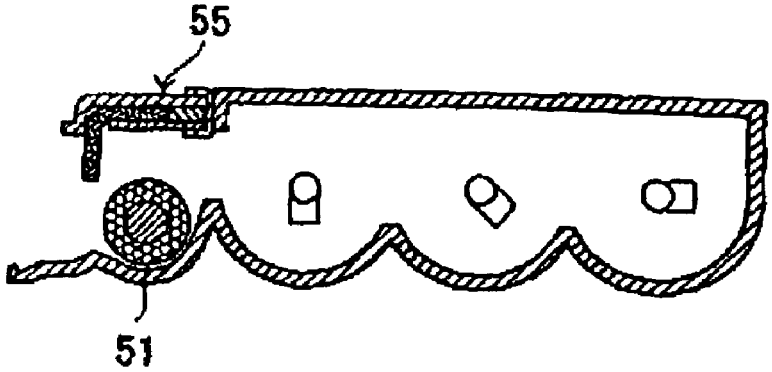

The development-unit assembling step is initiated by disposing the supply roller 51 in a predetermined position in the frame portion 47 of the toner storage 53, as shown in FIG. 7A. Then, the layer-thickness regulator 55, which has been prepared in the layer-thickness regulator preparing step shown in FIGS. 6A–6D, is attached to an upper portion of the frame portion 47 of the toner storage 53, as shown in FIG. 7B. In this instance, the screw bolts are introduced into the through-holes 57*b*, 58*b*, 59*b* of the layer-thickness regulator 55 and then screwed into the tapped holes 49 of the frame portion 74, with the bosses 48 of the frame portion 74 being fitted into the through-holes 57*a*, 58*a*, 59*a* of the layer-thickness regulator 55 (see FIG. 5). It is noted that FIGS. 7A and 7B cooperate to show a layer-thickness regulator attaching step.

Figure 7C:
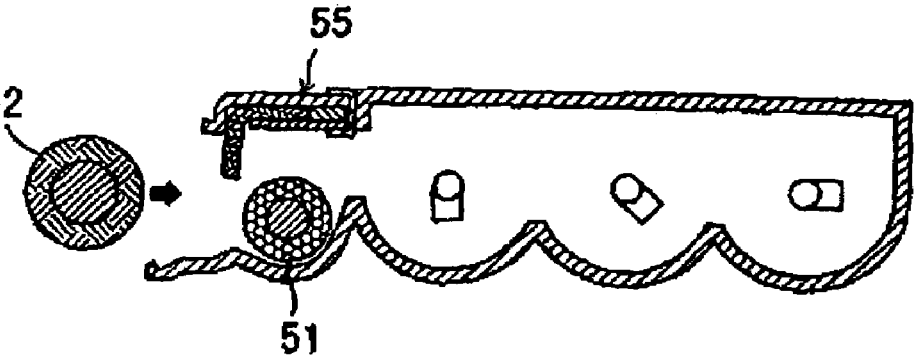
Figure 7D:
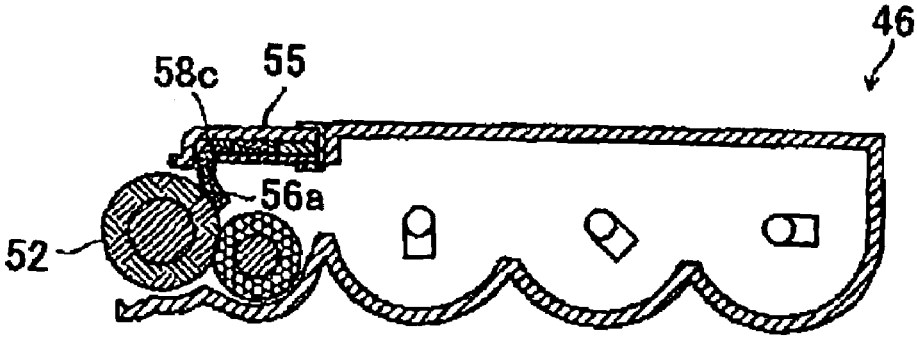

After the layer-thickness regulator 55 has been attached to the upper portion of the frame portion 47 of the toner storage 63, the developer roller 52 is attached to the frame portion 47 of the toner storage 53, by introducing the metallic axle 52*a* of the developer roller 52 into the cutouts 47*a* of the frame portion 47, as shown in FIGS. 7C and 7D. In this instance, the developer roller 62 can be easily attached to the frame portion 47 of the toner storage 53, since the blade 56 has been already bent in the above-described layer-thickness regulator preparing step. When the developer roller 52 is thus attached to the frame portion 47 of the toner storage 53, the blade 56 is further bent by the developer roller 52 which forces the contact portion 56*a* of the blade 56 in the rearward direction (i.e., in the rightward direction as shown in FIG. 7D), whereby a spacing gap G (see FIG. 3) is formed between the contact portion 56*a* of the blade 56 and the downwardly extending front end portion of the upper metallic plate 57. The pressing contact relation between the contact portion 56*a* of the blade 56 and the developer roller 52 with a sufficiently large pressing force can be established by simply forcing the developer roller 52 onto the contact portion 56*a* of the blade 56. It is noted that FIGS. 7C and 7D cooperate to show a developer receiver attaching step.

After the developer receiver attaching step has been implemented as described above, the toner storage 53 is filled with the toner particles of a predetermined color, which are introduced through a toner supply port (not shown). The process of manufacturing the development unit 46 is completed by this step of filling the toner storage 53 with the toner particles.

There will be described a printing operation performed by the image forming apparatus 1, with reference to FIG. 1.

A user of the image forming apparatus 1 opens the cover member 21 of the casing body 2, and disposes the development units 46K, 46C, 46M, 46Y in the storage portion 41 of the development section 11 such that each of the development units 46K, 46C, 46M, 46Y is positioned in a position assigned to the corresponding color. In this instance, the developer roller 48 (which is exposed to the exterior of the toner storage 53 through the opening formed in the front end portion of the toner storage 53) is not in contact with the photosensitive belt 61.

As the image data are transmitted from an external device, the laser scanner 62 is activated to generate the laser light 62*a* based on the transmitted image data.

The laser light 62*a* is projected upon the outside surface of the photosensitive belt 61 which has been charged by the charging device 63, whereby an electrostatic latent image based on the image date is created on the outside surface of the photosensitive belt 61.

Meanwhile, with rotation of each cam 26, namely, with placement of each cam 26 into its loading position, a corresponding one of the development units 46K, 46C, 46M, 46Y is forced by the lobe of each cam 26, so as to be displaced toward the photoreceptor section 12. FIG. 1 illustrates a state in which the development unit 46C (the second uppermost one of the four development units) is forced toward the photosensitive belt 61 by the lob of the corresponding cam 26 which is placed in its loading position.

The developer roller 52 of each of the development units 46K, 46C, 46M, 46Y is brought into contact at its outer circumferential surface 62*c* with the photosensitive belt 61, as a result of the displacement of each, of the development units 46K, 46C, 46M, 46Y Since the toner particles are uniformly deposited on the outer circumferential surface 52*c* (which serves as a depository surface of the developer receiver), the toner particles are transferred to the photosensitive belt 61 as a result of the contact of the outer circumferential surface 52*c* of the developer roller 52 with the photosensitive belt 61. The transferred toner particles cling to parts of the outside surface of the photosensitive belt 61 which cooperate to define the electrostatic latent image, so that the clinging toner particles cooperate to form the visible image.

The cam 26 is rotated to be placed back into its unloading position, when the visible image of the corresponding color for a single paper sheet P has been formed on the outside surface of the photosensitive belt 62. With the cam 26 being placed in its unloading position, namely, with disengagement of the development unit 46 from the lobe of the cam 26, the development unit 46 is displaced back in the rearward direction, by the coil spring (not shown) which is disposed on the front side of the development unit 46 and constantly biases the development unit 46 in the rearward direction.

The toner particles, transferred from the developer roller 48 to the photosensitive belt 61, are further transferred to the intermediate transfer belt 71. Excess or residue toner particles (which have not been transferred to the intermediate transfer belt 71 from the photosensitive belt 61) are removed by the cleaning unit 64. After the photosensitive belt 61 has been cleaned by the cleaning unit 64, the toner particles of another color are transferred to the photosensitive belt 61 from the developer roller 48.

The visible image of each color formed based on the image data is thus transferred from the photosensitive belt 61 to the intermediate transfer belt 71. When the visible images of the respective four colors have been transferred to the intermediate transfer belt 71, a desired full-color image is formed on the intermediate transfer belt 71. The full-color image is then transferred from the intermediate transfer belt 71 to the paper sheet P, when the paper sheet P passes through the transfer roller 75 and the second pulley roller 73.

After the full-color image has been transferred to the paper sheet P, the paper sheet P is fed to the fuser section 14. As the paper sheet P passes through the fuser rollers 81, 82 of the fuser section 14, the full-color image is fixed to the paper sheet P. The paper sheet P, on which the permanent image has been formed, is fed by the feed rollers 86 so as to come out of the casing body 2 through the media exit portion 22, whereby the printing operation is completed.

As described above, the base portion 56*b* of the blade 56 is fixed relative to the ceiling wall 46*a* of the toner storage 53 so as to be held in a horizontal posture, while the angle A defined by the contact portion 56*a* and the base portion 56*b* of the blade 56 is smaller than 90°. Thus, the development unit 46 can be made small in its vertical dimension, while the contact portion 56*a* of the blade 56 can be held in contact at its surface with the outer circumferential surface 52*c* of the developer roller 52, making it possible to assure the thickness uniformity of the toner layer. Since the above-described angle A is adapted to be smaller than 90°, the base portion 56*b* of the blade 56 can be disposed in parallel with the ceiling wall 46*a* of the toner storage 53, without the base portion 56*b* being brought into contact with the photosensitive belt 61. Further, since the blade 56 bent more than 90° is forced by the developer roller 52 in such a direction that increases the degree of bend of the blade 56, the bent blade 56 is given an elastic force for restoring itself to its original shape. This force acts as a pressing force by which the contact portion 56*a* of the blade 56 and the developer roller 52 are pressed against each other. Still further, since the contact portion 56*a* of the blade 56, which projects downwardly from the base portion 56*b* of the blade 56, is curved at its part contiguous to the base portion 56*b*, the pressing force applied from the contact portion 56*a* to the developer roller 62 is sufficiently large even where the contact portion 56*a* has a small length.

Further, since the blade 56 is bent in such a manner that permits the base portion 56*b* of the blade 56 to extend in the horizontal direction of the development unit 46 rather than in the vertical direction of the development unit 46, the development unit 46 does not have to have a large height or vertical dimension for fixing the blade 56 relative to the toner storage 53, whereby the development unit 46 can be made thin or small in its vertical dimension. Therefore, even if the base portion 56*b* of the blade 56 or the blade supporter (constituted by the upper and lower metallic plates 57, 58) is required to have an increased length, for example, in the interest of facilitating the operation to attach the layer-thickness regulator 55 to the toner storage 53, such an increase in the length does not lead to an increase in the height or vertical dimension of the development unit 46. Further, since the layer-thickness regulator 55 can be assembled as a unit such that the blade 56 is held bent by the upper metallic blade 57, the developer roller 52 can be easily attached to the toner storage 53 in the process of assembling the development unit 46.

Further, in the present embodiment in which the blade 56 as the regulator body or plate is made of a rubber material (such as silicon rubber) having a high degree of elasticity, the blade 56 is given a high degree of elastic force for restoring itself to its original shape. This high degree of elastic force acts as a high degree of pressing form by which the contact portion 56*a* of the blade 56 and the developer roller 52 are pressed against each other, making it possible to reliably assure he thickness uniformity of the toner layer. This pressing force provided by the elastic force of the blade 56 is dependent upon the position of the above-described fulcrum (about which the blade 56 is bent) but is constant irrespective of a dimensional accuracy of the component as long as it has a constant thickness.

Further, in the present embodiment in which the above-described furculum is provided by the end 58*c* of the lower metallic plate 58, the position of the furculum relative to the developer roller 52 can be held constant without its variation, whereby the pressing force acting on the developer roller 52 can be constant without its variation.

While the presently preferred embodiment of the invention has been described above in detail, it is to be understood that the invention is not limited to the details of the illustrated embodiment, but may be otherwise embodied without departing from the sprit of the invention.

While the image forming apparatus takes a form of a color laser printer of four-cycle type in the above-described embodiment, the image forming apparatus may be provided by a color laser printer of tandem type. Further, the image forming apparatus does not have to be necessarily provided by a color printer, but may be also provided by a monochrome printer.

Figure 8:
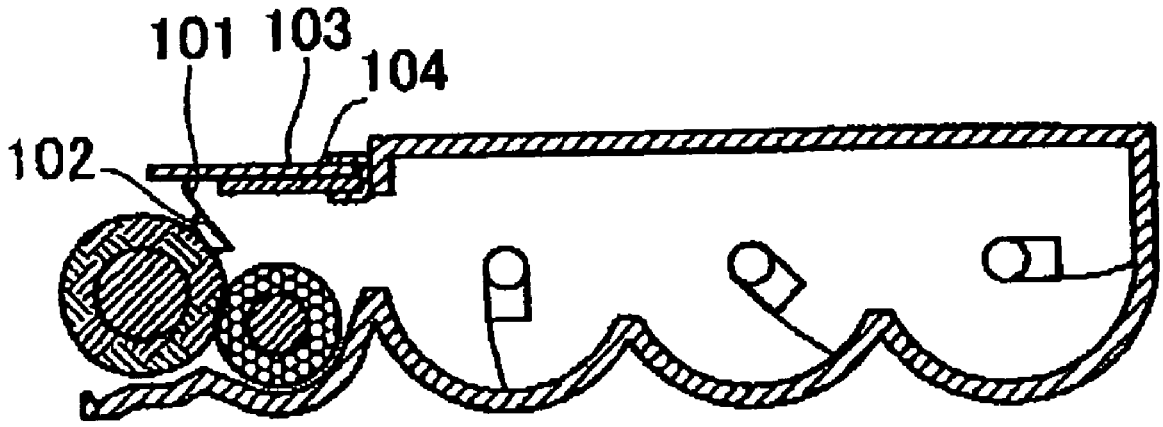
FIG. 8 is a side view partially in cross section of a modification of the layer-thickness regulator.

The regulator plate does not have to be necessarily provided by a silicon-rubber made blade such as the above-describe blade 56, but may be provided by a blade made of other rubber material such as urethane rubber. Further, the regulator plate may be provided by a blade made of a metallic material such as stainless steel (SUS). FIG. 8 is a view showing a modification of the layer-thickness regulator in which the regulator plate is provided by a metal plate 101 made of stainless steel and an elastic member 102 made of silicon-rubber or other rubber material. The elastic member 102 is bonded to the contact portion of the metal plate 101. In this modified layer-thickness regulator in which the regulator plate constituted principally by the metal plate 101 is deformable in a plastic manner rather than in an elastic manner, the regulator plate is capable of maintaining its bent or otherwise deformed shape. Therefore, in this modified layer-thickness regulator, after having been once bent, the regulator plate can maintain its bent shape even in absence of a member such as the above-described upper metallic plate 57 which is configured to keep the regulator plate to be bent. That is, even without such a member as the upper metallic plate 57, the modified layer-thickness regulator facilitates the developer roller to be attached to the toner storage.

Further, this modified layer-thickness regulator may include, in addition to the regulator plate, the blade supporter in the form of upper and lower metallic plates 103, 104 which cooperate with each other to grip the base portion of the metal plate 101, so that the modified layer-thickness regulator can be attached to the frame portion 47 of the toner storage 53 in the same manner as shown in FIG. 5. In this arrangement in which the metal plate 101 is fixed relative to the toner storage 56 through the blade supporter which grips the base portion of the metal plate 101, the metal plate 101 does not have to have through-holes for receiving positioning protrusions or screw bolts, and enables the contact portion to be pressed evenly in its entirety, against the depository surface of the developer roller 52.

Figure 9:
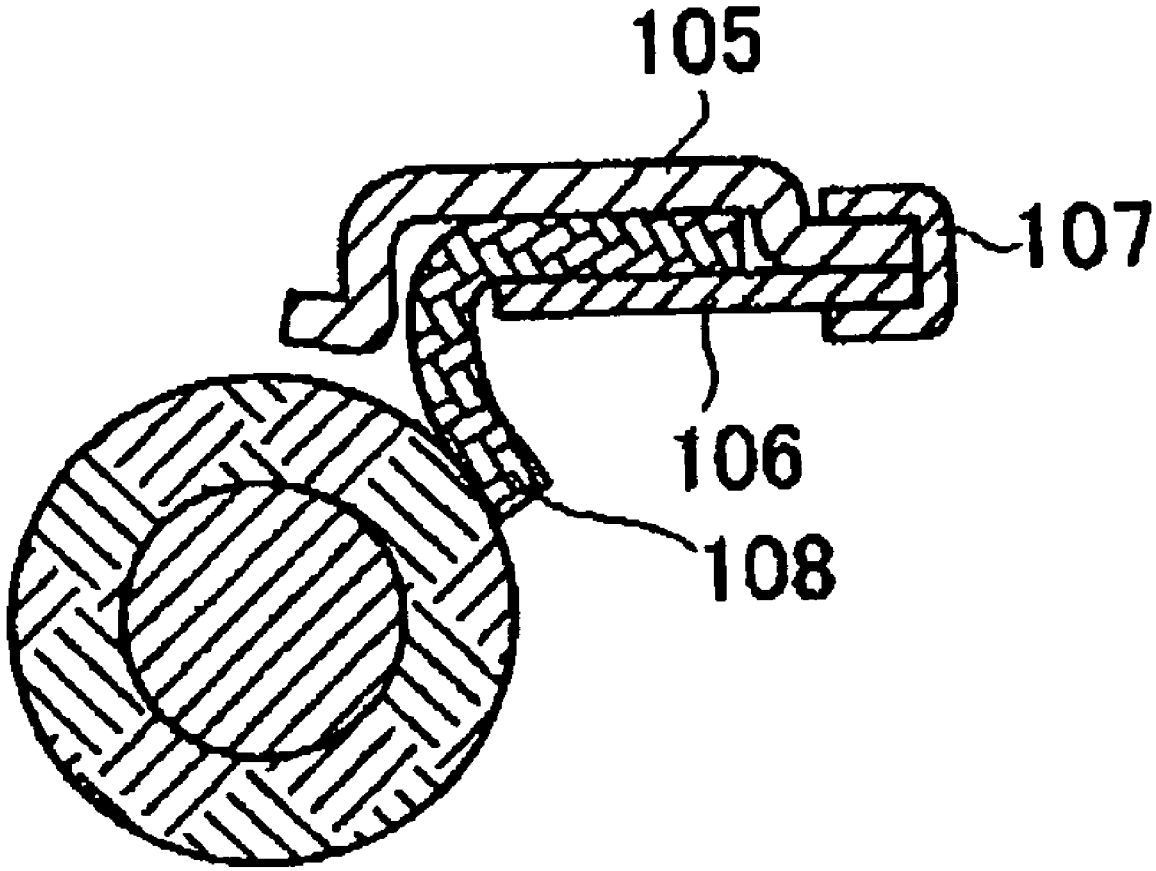
FIG. 9 is a side view partially in cross section of another modification of the layer-thickness regulator.

In the above-described embodiment, the spacer in the form of the spacer member 59 is interposed between the upper and lower metallic plates 57, 58. However, the spacer is not essential. Where the spacer is not provided, the supporter for supporting the regulator plate is preferably configured as shown in FIG. 9 which shows another modification of the layer-thickness regulator. In this modified layer-thickness regulator, upper and lower metallic plates 105, 106 are held in contact at their proximal end portions with each other, without the spacer interposed therebetween. The upper metallic plate 105 is bent such that the upper and lower metallic plates 105, 106 are spaced apart from each other at their non-proximal-end portions by a distance corresponding to a thickness of a blade 108 which is interposed therebetween. The blade 108 is gripped by and between the upper and lower metallic plates 105, 106 which are fixed to each other by clamp members 107 as the fixture. The distance between the non-proximal-end portions of the upper and lower metallic plates 105, 106 are held constant, whereby the thickness of the blade 108 is held constant without the blade 108 being crushed by the metallic plates 105, 106.

In the above-described embodiment, the blade 56 as the regulator plate is fixed to the toner storage 53 through the metallic plates 58, 57 as the first and second support members. However, the regulator plate may be fixed directly to the toner storage 53 without the first and second support members.

In the above-described embodiment, the fixture for fixing the regulator plate to the first and second support members is provided by the two U-shaped clamp members 60 which are arranged to grip the respective two portions of the rear end portion of the assembly of the blade 56, metallic plates 57, 58 and spacer member 59. However, the fixture may be provided by only one U-shaped clamp member for griping one portion of the assembly, or alternatively, may be provided by three or more U-shaped clamp members for griping three or more portions of the assembly, namely, almost an entirety of the assembly. Further, the fixture may be provided by a screw bolt or bolts in place of the U-shaped clamp member or members.

What is claimed is:

1. A development unit comprising:

a developer storage storing a developer;

a developer receiver disposed in one of opposite end portions of said developer storage and having a depository surface on which the developer is to be deposited; and a regulator including a contact portion which is held in pressing contact with said depository surface of said developer receiver so as to regulate a thickness of the developer deposited on said depository surface of said developer receiver, wherein said regulator further includes a base portion which is contiguous to said contact portion and which extends from said contact portion in a direction toward the other of said opposite end portions of said developer storage, and an acute angle is defined by a base-portion plane on which said base portion of said regulator lies and a tangential plane which is tangent, at a contact portion of said depository surface held in contact with said contact portion of said regulator, to said depository surface.

2. The development unit according to claim 1, wherein said developer receiver is provided by a roller, and said depository surface is provided by an outer circumferential surface of said roller, and wherein said regulator is positioned relative to said roller as said developer receiver, such that said contact portion of said depository surface is located between an axis of said roller and said other of said opposite end portions of said developer storage as viewed in said direction in which said base portion of said regulator extends.

3. The development unit according to claim 1, wherein said developer receiver is provided by a roller, and said depository surface is provided by an outer circumferential surface of said roller, and wherein said regulator is positioned relative to said roller as said developer receiver, such that an intersection between said base-portion plane and said tangential plane is located between an axis of said roller and said other of said opposite end portions of said developer storage as viewed in said direction in which said base portion of said regulator extends.

4. The development unit according to claim 1, wherein said regulator is bent more than 90°.

5. The development unit according to claim 4, wherein said regulator is provided by an elastic body.

6. The development unit according to claim 4, wherein said regulator includes a portion made of a rubber material.

7. The development unit according to claim 4, wherein said regulator is made of a rubber material, and has a thickness of 1.0–2.5 mm.

8. The development unit according to claim 1, further comprising a support member fixed to said developer storage and supporting said regulator, wherein said support member is held in contact with one of opposite side surfaces of said base portion of said regulator, and has an end serving as a fulcrum about which said regulator is bent.

9. The development unit according to claim 8, further comprising, in addition to said support member as a first support member, a second support member which includes a contact portion held in contact with the other of said opposite side surfaces of said base portion of said regulator, wherein said second support member is bent and further includes an end portion extending in a direction away from said contact portion of said second support member toward said first support member.

10. The development unit according to claim 9, wherein said contact portion of said regulator is forced by said developer receiver in such a direction that increases a degree of bend of said regulator, and is spaced apart from said end portion of said second support member.

11. The development unit according to claim 1, further comprising a supporter fixed to said developer storage and supporting said regulator, wherein said supporter supporting said regulator is configured to render said regulator bent such that said contact portion of said regulator is inclined with respect to said base portion of said regulator.

12. The development unit according to claim 1, wherein said regulator includes a portion which is provided by a metal plate.

13. The development unit according to claim 9, further comprising a spacer which is provided by a rigid member and which is interposed between said first support member and said second support member so as to define a distance between said first and second support members.

14. The development unit according to claim 13, wherein said developer storage includes an opening-definer portion which defines an opening of said developer storage, and which is provided by said one of said opposite end portions, wherein said developer receiver is provided by a roller which is rotatable about an axis thereof and which is exposed to an exterior of said developer storage through said opening, wherein each of said first support member, said second support member and said spacer, which are superposed on each other, has a pair of holes formed in respective opposite end portions thereof as viewed in an axial direction of said roller as said developer receiver, wherein said opening-definer portion of said developer storage has a pair of positioning protrusions formed in respective opposite end portions thereof as viewed in said axial direction, and wherein said first support member, said second support member and said spacer are fixed to said opening-definer portion of said developer storage, with said positioning protrusions being fitted in said holes.

15. A development unit comprising:

a regulator which is provided by an elastic body;

a first support member which is disposed on one of opposite sides of said regulator so as to support said regulator, and which has an end serving as a fulcrum about which said regulator is to be bent;

a second support member which is disposed on the other of said opposite sides of said regulator, and which is bent to include an end portion extending in a direction toward said first support member, so as to render said regulator bent about said fulcrum; and a developer receiver which receives a developer;

wherein said regulator is forced by said developer receiver in such a direction that increases a degree of bend of said regulator.

16. An image forming apparatus comprising:

the development unit defined in claim 1 and operable to convert a latent image into a visible image; and a transfer unit operable to transfer the visible image to a medium.

17. A layer-thickness regulator for regulating a thickness of a layer formed of a developer deposited on a depositary surface of a developer receiver which is disposed in a developer storage storing the developer, said layer-thickness regulator comprising:

a regulator body made of an elastic material, and including a contact portion which is to be held in pressing contact with the depositary surface of the developer receiver, and a base portion which is contiguous to said contact portion; and a supporter fixed to said developer storage and supporting said regulator body, wherein said supporter supporting said regulator body is configured to render said regulator body bent such that said contact portion of said regulator body is inclined with respect to said base portion of said regulator body.

18. The layer-thickness regulator according to claim 17, wherein said supporter includes:

a first plate member held in contact with one of opposite side surfaces of said base portion of said regulator body; and a second plate member including a contact portion held in contact with the other of said opposite side surfaces of said base portion of said regulator body, wherein said second plate member is bent so as to further include an end portion extending in a direction away from said contact portion of said second plate member toward said first plate member, so that said regulator body interposed between said first and second plate members is bent about an end of said first plate member.

19. A development unit comprising:

a developer storage storing a developer;

a developer receiver disposed in said developer storage and having a depository surface on which the developer is to be deposited; and the layer-thickness regulator defined in claim 18.

20. A method of manufacturing the development unit defined in claim 19, comprising:

a layer-thickness regulator preparing step of preparing said layer-thickness regulator, by interposing said regulator body between said first and second plate members, such that said regulator body is bent about said end of said first plate member;

a layer-thickness regulator attaching step of attaching the prepared layer-thickness regulator to said developer storage; and a developer receiver attaching step of attaching said developer receiver to said developer storage, and rendering said developer receiver to force said contact portion of said regulator body in such a direction that increases a degree of bend of said regulator body.

21. The method according to claim 20, wherein said layer-thickness regulator preparing step includes:

a first sub-step of disposing said first and second plate members onto respective opposite side surfaces of said regulator body, and rendering said regulator body bent about said end of said first plate member; and a second sub-step of fixing said regulator body to said first and second plate members by a fixture, so that said regulator body is gripped by said first and second plate members.

22. The method according to claim 20, wherein said development unit further comprising a positioning mechanism which establishes a predetermined positional relationship between said layer-thickness regulator and said developer storage, and which is constituted by engagers provided in the respective layer-thickness regulator and developer storage that are engaged with each other, and wherein said layer-thickness regulator attaching step is implemented by attaching said layer-thickness regulator to said developer storage while bringing said engagers into engagement with each other.

23. The development unit according to claim 1, wherein said regulator is an elastic plate that is bent more than 90°.

24. The development unit according to claim 23, wherein said elastic plate as said regulator is elastically bent more than 90°.

25. The development unit according to claim 24, wherein said elastic plate as said regulator is made of a rubber material.

26. The development unit according to claim 1, wherein said base portion of said regulator is fixed relative to said developer storage such that said base portion is held in a fixed posture.

27. The development unit according to claim 26, further comprising a supporter supporting said regulator such that said regulator is fixed at said base portion thereof to said supporter, wherein said supporter is fixed to said developer storage so that said base portion of said regulator is fixed relative to said developer storage.

28. The development unit according to claim 27, wherein said regulator is bent such that said contact portion of said regulator is inclined with respect to said base portion of said regulator, and wherein said supporter includes first and second supporting members which are held in contact with respective opposite side surfaces of said base portion of said regulator.

29. The development unit according to claim 1, further comprising a pair of support plates that cooperate with each other to grip said base portion of said regulator, wherein one of said support plates has an end serving as a fulcrum about which said regulator is bent.

* * * * *